US007680441B2

(12) United States Patent
Yoon

(10) Patent No.: US 7,680,441 B2
(45) Date of Patent: Mar. 16, 2010

(54) IMAGE FORMING APPARATUS

(75) Inventor: Young-min Yoon, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 785 days.

(21) Appl. No.: 11/502,383

(22) Filed: Aug. 11, 2006

(65) Prior Publication Data

US 2007/0081831 A1 Apr. 12, 2007

(30) Foreign Application Priority Data

Oct. 7, 2005 (KR) ..... 10-2005-0094511

(51) Int. Cl.
*G03G 15/01* (2006.01)

(52) U.S. Cl. ..... 399/228; 399/222

(58) Field of Classification Search ..... 399/222, 399/228

See application file for complete search history.

(56) References Cited

U.S. PATENT DOCUMENTS 5,099,278 A * 3/1992 Sato ..... 399/75

FOREIGN PATENT DOCUMENTS

JP 03-107619 5/1991
JP 08-054778 2/1996
JP 10-148985 6/1998
JP 2002099129 A * 4/2002
JP 2004-002014 1/2004

OTHER PUBLICATIONS

English Translation of Terada, JP 2002099129A.*

* cited by examiner

*Primary Examiner*—David M Gray
*Assistant Examiner*—Ryan D Walsh
(74) *Attorney, Agent, or Firm*—Roylance, Abrams, Berdo & Goodman, LLP

(57) ABSTRACT

An image forming apparatus is provided. The image forming apparatus includes a plurality of developing units. A cam shaft includes a plurality of cams having different rotation phases respectively corresponding to the plurality of developing units. A regulation means controls a rotational force of a driving force source that is transferred to the cam shaft. The regulation means includes a spring clutch having a plurality of latch portions of which phases correspond to the plurality of cams, and an actuator that is selectively connected to the plurality of latch portions and corresponds the plurality of cams to the plurality of developing units. A control means is disposed at the spring clutch and substantially prevents the cam shaft from excessive rotation to prevent the cams from being separated from a corresponding position with respect to the selected developing unit.

17 Claims, 8 Drawing Sheets

IMAGE FORMING APPARATUS

CROSS-REFERENCE TO RELATED PATENT APPLICATION

This application claims the benefit under 35 U.S.C. § 119 (a) of Korean Patent Application No. 10-2005-0094511 filed on Oct. 7, 2005, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to an image forming apparatus that sequentially operates a plurality of developing units to form a color image.

2. Description of the Related Art

A common electrophotographic image forming apparatus illuminates light onto a uniformly charged photoconductive medium to form an electrostatic latent image. The electrostatic latent image is developed using a toner to form a toner image. The developed image is transferred and fused onto a sheet of paper to form a color image. Generally, colors of yellow Y, magenta M, cyan C, and black K are used in a color image forming apparatus. Accordingly, four developing units are required for attaching the toners of the four colors onto the electrostatic latent image.

Examples of methods of forming a color image include a single-pass method in which respective four exposing units and four photoconductive mediums are provided, and a multi-pass method in which one exposing unit and one photoconductive medium are provided.

In a color image forming apparatus using the single-pass method, the time required for printing a color image is the same as in printing a black and white image. Therefore, it is mainly used in a high speed color image forming apparatus. However, the price of the apparatus becomes expensive since four exposing units and four photoconductive drums are required. To avoid this problem, in a color image forming apparatus operating at a relatively low speed, the multi-pass method is used in which one photoconductive drum and one exposing unit are provided. A color toner image is formed on an intermediate transfer medium by repeating the exposing, developing, and transferring steps with respect to each color, thereby transferring and fusing the color toner image onto a sheet of paper.

In the image forming apparatus using the multi-pass method, because four developing units are sequentially operated, a device is required for sequentially transferring a rotational force of a driving motor. To this end, a conventional image forming apparatus has used four electrical clutches. However, the electrical clutches are expensive and large. Additionally, because sliding may occur during clutching, there has been a problem in that a driving force cannot be timely regulated.

Accordingly, a need exists for an image forming apparatus having improved regulation of the driving force transferred to a developing unit.

SUMMARY OF THE INVENTION

The present invention provides an image forming apparatus that reliably regulates a driving force transferred to a developing unit.

According to an aspect of the present invention, an image forming apparatus includes a plurality of developing units. A cam shaft includes a plurality of cams having different rotation phases respectively corresponding to the plurality of developing units. A regulation means controls a rotational force of a driving force source that is transferred to the cam shaft. The regulation means includes a spring clutch having a plurality of latch portions of which phases correspond to the plurality of cams, and an actuator that is selectively connected to the plurality of latch portions and corresponds the plurality of cams to the plurality of developing units. A control means is disposed at the spring clutch and substantially prevents the cam shaft from excessive rotating to prevent the cams from being separated from a corresponding position with respect to the selected developing unit.

Other objects, advantages, and salient features of the invention will become apparent to those skilled in the art from the following detailed description, which, taken in conjunction with the annexed drawings, discloses exemplary embodiments of the invention

BRIEF DESCRIPTION OF THE DRAWINGS

The above and other features and advantages of the present invention will become more apparent by describing in detail exemplary embodiments thereof with reference to the attached drawings, in which.

Throughout the drawings, the same drawing reference numerals will be understood to refer to the same elements, features, and structures

DETAILED DESCRIPTION OF EXEMPLARY EMBODIMENTS

Hereinafter, exemplary embodiments of the present invention are described in detail with reference to the accompanying drawings.

Figure 1:
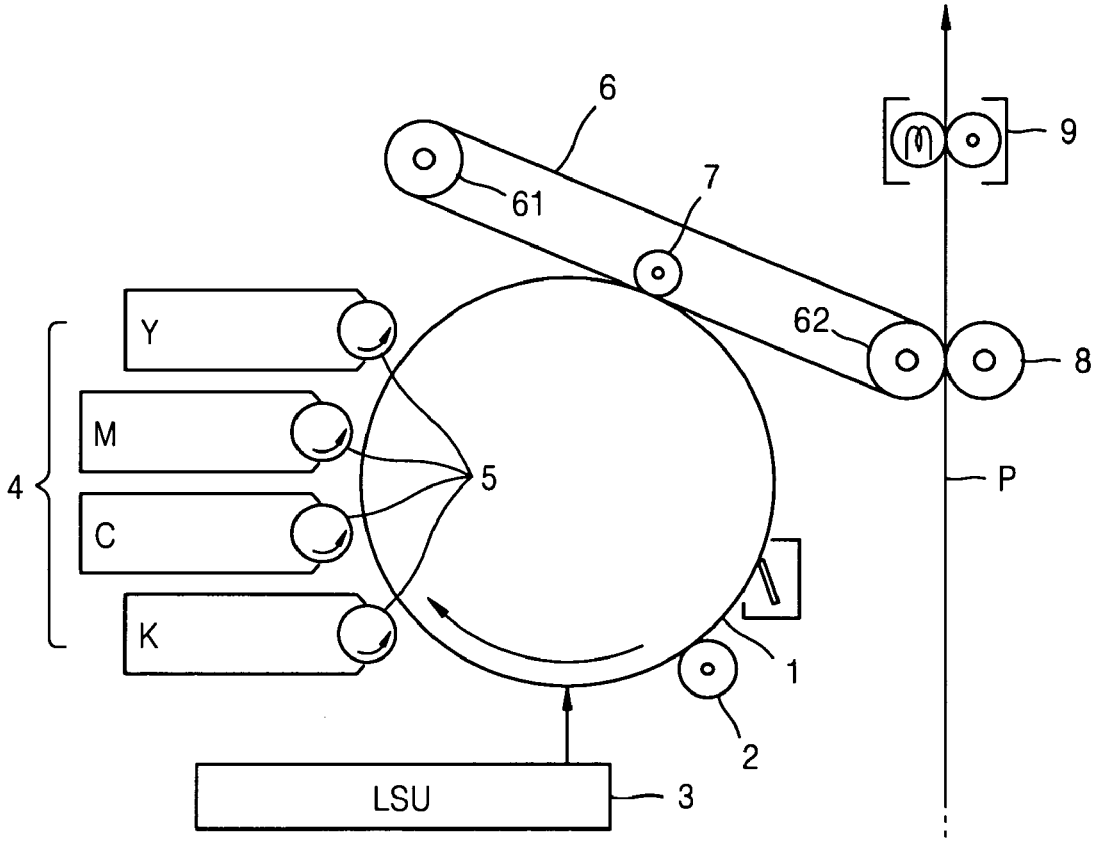
FIG. 1 is a schematic view of a structure of an image forming apparatus using a multi-pass method according to an exemplary embodiment of the present invention.

Referring to FIG. 1, an image forming apparatus includes a photoconductive drum 1, a charging roller 2, an exposing unit 3, developing units 4, an intermediate transfer belt 6, a first transfer roller 7, a second transfer roller 8, and a fixing unit 9.

The photoconductive drum 1 is a cylindrical metal drum having a photoconductive layer on an outer circumferential surface thereof.

The charging roller 2 is an example of a charger that equipotentially charges the photoconductive drum 1. The charging roller 2 equipotentially charges the outer circumferential surface of the photoconductive drum 1 by supplying an electric charge while rotating in contact or non-contact with the outer circumferential surface of the photoconductive drum 1. A corona discharger (not shown) may be used for a charger instead of the charging roller 2.

The exposing unit 3 forms an electrostatic latent image by illuminating light corresponding to image data onto the equipotentially charged photoconductive drum 1. A laser scanning unit (LSU) using a laser diode as a light source is commonly used for the exposing unit 3.

For color printing, the image forming apparatus of the present invention uses toners of cyan C, magenta M, yellow Y, and black B.

The image forming apparatus of the present invention includes four developing units 4 containing respective toners of cyan C, magenta M, yellow Y, and black B. Each of the developing units 4 includes a developing roller 5. The developing units 4, which are disposed such that the developing roller 5 is separated from the photoconductive drum 1 by a development gap, perform a non-contact type development. Preferably, the development gap is approximately tens to hundreds of microns. In addition to the developing roller 5, the developing units 4 may further provide a supply roller (not shown) for supplying a toner to the developing roller 5 and an agitator (not shown).

The intermediate transfer belt 6 is supported by supporting rollers 61 and 62 and travels at substantially the same speed as the rotational linear velocity of the photoconductive drum 1. The length of the intermediate transfer belt 6 must be equal to or greater than the length of the maximum size paper P used in the image forming apparatus.

The first transfer roller 7 faces the photoconductive drum 1. A first transfer bias is applied to the first transfer roller for transferring a toner image developed on the photoconductive drum 1 to the intermediate transfer belt 6.

The second transfer roller 8 faces the intermediate transfer belt 6. During the toner image transfer from the photoconductive drum 1 to the intermediate transfer belt 6, the second transfer roller 8 is separated from the intermediate transfer belt 6. When the toner image is completely transferred onto the intermediate transfer belt 6, the second transfer roller 8 comes into contact with the intermediate transfer belt 6 with a predetermined pressure. A second transfer bias for transferring the toner image to the paper P is applied to the second transfer roller 8.

Processes of image forming according to the aforementioned configuration are described hereafter. Light corresponding to a first image data, such as yellow Y image data, is illuminated from the exposing unit 3 to the equipotentially charged photoconductive drum 1 by the charging roller 2. An electrostatic latent image corresponding to the yellow Y image is formed on the photoconductive drum 1. A developing bias is applied to the developing roller 5 of a yellow developing unit 4Y. Then, a yellow Y toner is attached onto the electrostatic latent image, and a yellow Y toner image is developed onto the photoconductive drum 1. The yellow Y toner image is transferred onto the intermediate transfer belt 6 by the first transfer bias that applies to the first transfer roller 7. When a page of the yellow Y toner image is completely transferred, the exposing unit 3 illuminates light corresponding to a second image data, such as magenta M image data, onto the equipotentially recharged photoconductive drum 1 by the charging roller 2 to form the electrostatic latent image corresponding to a magenta M image. A magenta developing unit 4M performs a development by supplying a magenta M toner onto the electrostatic latent image. A magenta M toner image formed on the photoconductive drum 1 is transferred onto the intermediate transfer belt 6 to be superimposed on the pre-transferred yellow Y toner image. When the aforementioned processes are carried out with respect to cyan C and black K, a color toner image having superimposed colors of yellow Y, magenta M, cyan C, and black K is formed. The color toner image is transferred by the second transfer bias onto the paper P that passes between the intermediate transfer belt 6 and the second transfer roller 8. The fixing unit 9 fuses the color toner image onto the paper P by applying heat and pressure.

As mentioned above, in a color image forming apparatus using a multi-pass method, a plurality of developing units 4 are sequentially operated. The developing bias may be applied to the developing roller 5 of a selected developing unit (for example, 4Y), and the developing bias may not be applied to the developing roller 5 of the other developing units (for example, 4M, 4C, and 4K), or an anti-developing bias for preventing toner from developing may be applied thereto. Preferably, only the developing roller 5 of the selected developing unit (for example, 4Y) rotates and the other developing units (for example, 4M, 4C, and 4K) do not rotate. To this end, the image forming apparatus includes a driving force transfer means for selectively transferring a driving force to the plurality of developing units 4 and cams for operating the driving force transfer means.

Figure 3:
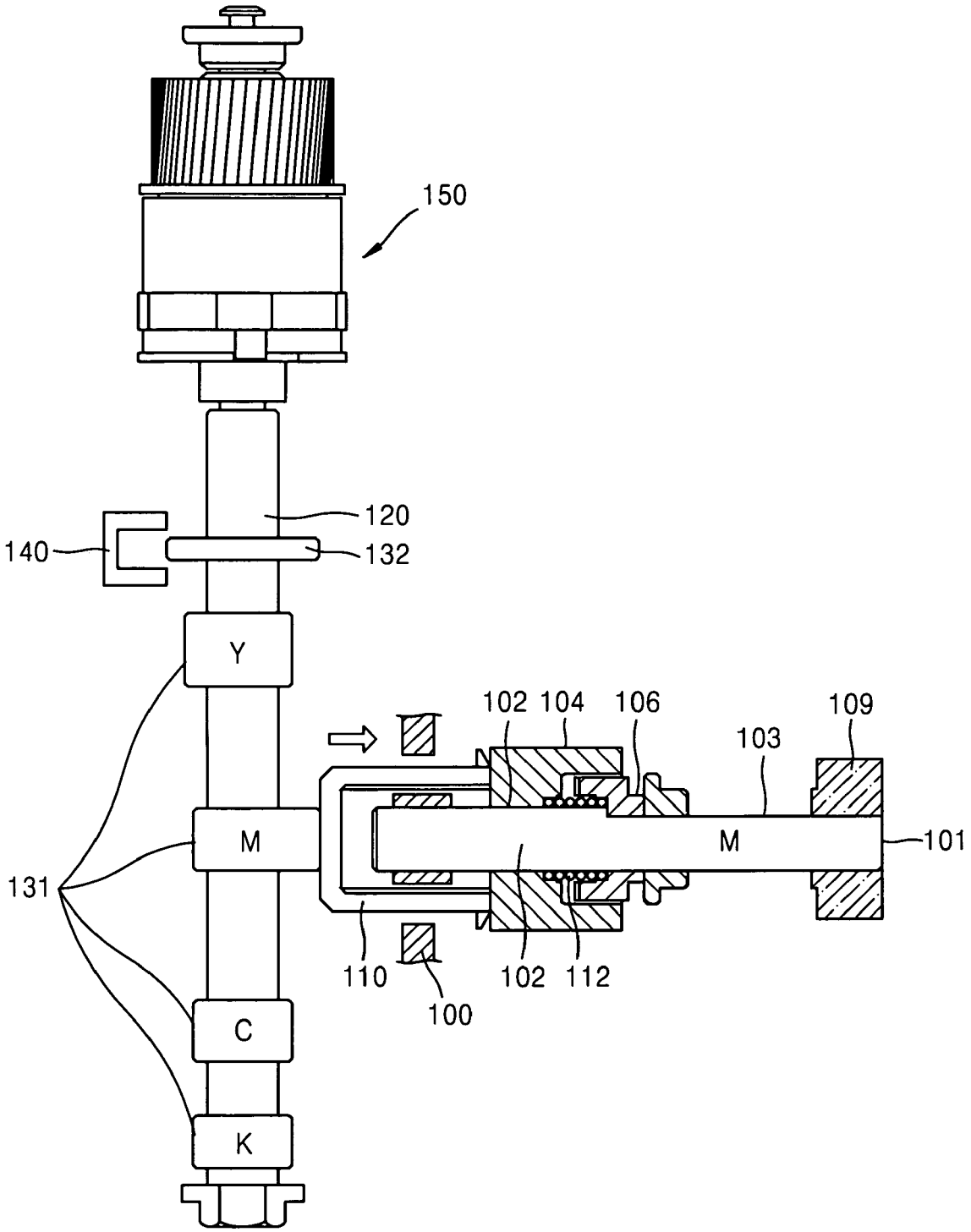
FIG. 3 is a plan view in partial cross section of the apparatus FIG. 2.
Figure 4:
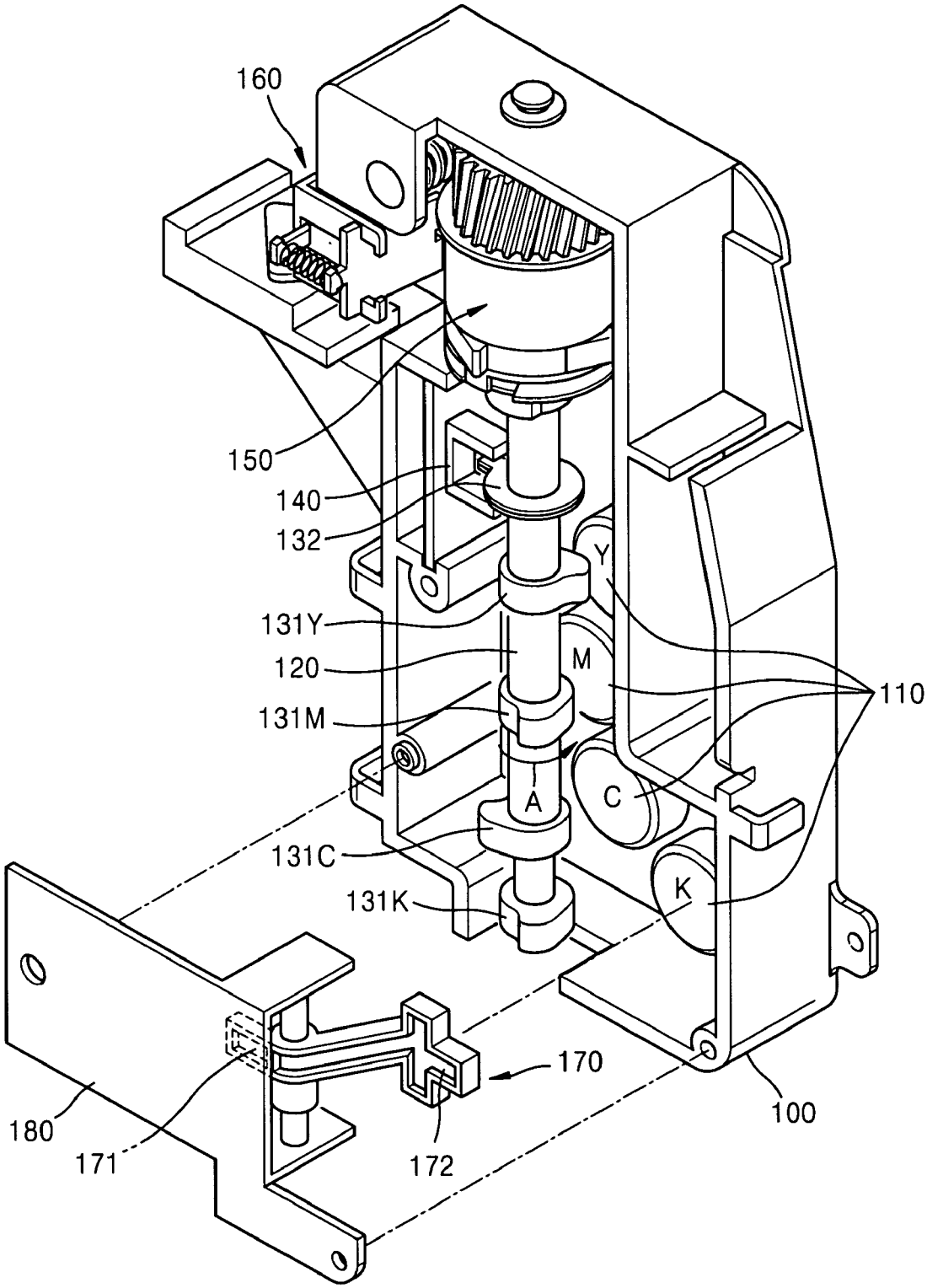
FIG. 4 is a rear perspective view of FIG. 2.
Figure 5:
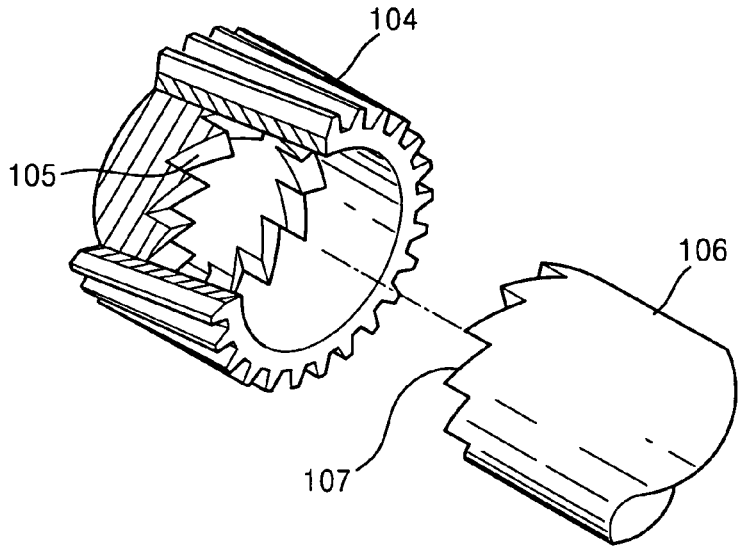
FIG. 5 is an exploded perspective view of a sliding hub and a fixed hub according to an exemplary embodiment of the present invention.

Referring to FIGS. 2 to 6, four shafts 101 are rotatably disposed at a bracket 100. Each of the shafts 101 includes a cylinder portion 102 and a chamfer portion 103. A sliding hub 104 is disposed at the cylinder portion 102. A fixed hub 106 is disposed at one end portion of the chamfer portion 103, and a driving gear 109 is disposed at the other end portion thereof. An elastic member 112 elastically biases the sliding hub 104 in a direction separated from the fixed hub 106. A sliding hub 104Y is connected with a driving motor 10 (driving source) by the use of gears 11 and 12. A sliding hub 104M is connected with the sliding hub 104Y by the use of a gear 13. The sliding hub 104C is connected with the driving motor 10 by the use of a plurality of gears (not shown). The sliding hub 104K is connected with the sliding hub 104C by the use of a gear 14. As shown in FIG. 5, the sliding hub 104 and the fixed hub 106 respectively include engagement portions 105 and 107 having complementary shapes. Thus, when the sliding hub 104 and the fixed hub 106 are engaged, a driving force of the driving motor 10 is transferred up to the fixed hub 106, and the shaft 101 and the driving gear 109 rotate. The driving gear 109 is connected with a driven gear (not shown) provided at the developing units 4. The driven gear is connected with driving elements disposed in the developing units 4, including the developing roller 5.

By the aforementioned configuration, the four sliding hubs 104 may be selectively slid to be engaged with the four fixed hubs 106 to selectively drive the four developing units 4.

Figure 6:
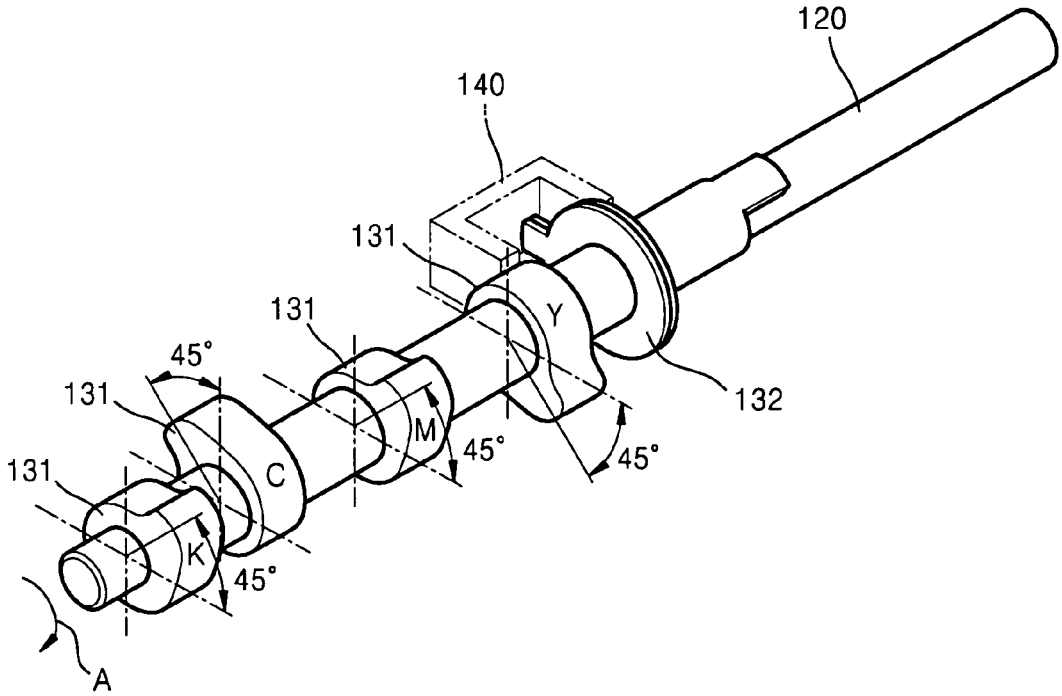
FIG. 6 is a perspective view of a cam shaft and cams according to an exemplary embodiment of the present invention.

Referring to FIG. 6, the image forming apparatus includes a cam shaft 120 and four cams 131 to selectively slide the four sliding hubs 104.

The four cams 131 are fixed to the cam shaft 120 in a corresponding manner to the respective four sliding hubs 104. The four cams 131 and the cam shaft 120 are preferably formed in a built-in manner by plastic injection molding. The four cams 131C, 131M, 131Y and 131K correspond to the plurality of developing units 4C, 4M, 4Y and 4K, respectively, and sequentially operate the plurality of developing units 4C, 4M, 4Y and 4K as the cam shaft 120 rotates. When the cam shaft 120 rotates, the four sliding hubs 104 are sequentially pushed by the four cams 131 to be connected with the fixed hub 106 facing thereto.

The image forming apparatus of the exemplary embodiments of the present embodiment includes four push-caps 110. The cams 131 push the push-caps 110 to slide the sliding hub 104.

Preferably, the cams 131 smoothly connect the sliding hub 104 with the fixed hub 106 and are disposed within a path that separates the sliding hub 104 from the fixed hub 106 as quickly as possible.

Referring to FIG. 4, cams 131Y, 131M, and 131C push push-caps 110Y, 110M, and 110C respectively, but it is difficult to directly push the push-cap 110K because a cam 131K is located far from the push-cap 110K. Thus, a connection member 170 connecting the cam. 131K and the push-cap 110K is provided. The connection member 170 is rotatably connected with a cover 180, and the cover 180 is connected with the bracket 100. When the cam 131K pushes one end portion 171 of the connection member 170, the connection member 170 rotates, and the other end portion 172 pushes the push-cap 110K.

The cams 131Y, 131M, 131C, and 131K are disposed as shown in FIG. 6. The cams 131M and 131C have phase differences of approximately 90 degrees and approximately 180 degrees, respectively, in a reverse direction with respect to a rotation direction A of the cam 131Y and the cam shaft 120. The cam 131K pushes the push-cap 110K by operating the connection member 170. The one end portion 171 of the connection member 170 is disposed opposite to the push-cap 110K. Thus, the cam 131K has a phase difference of approximately 270 degrees in a reverse direction with respect to the rotation direction A of the cam 131Y and the cam shaft 120.

Figure 2:
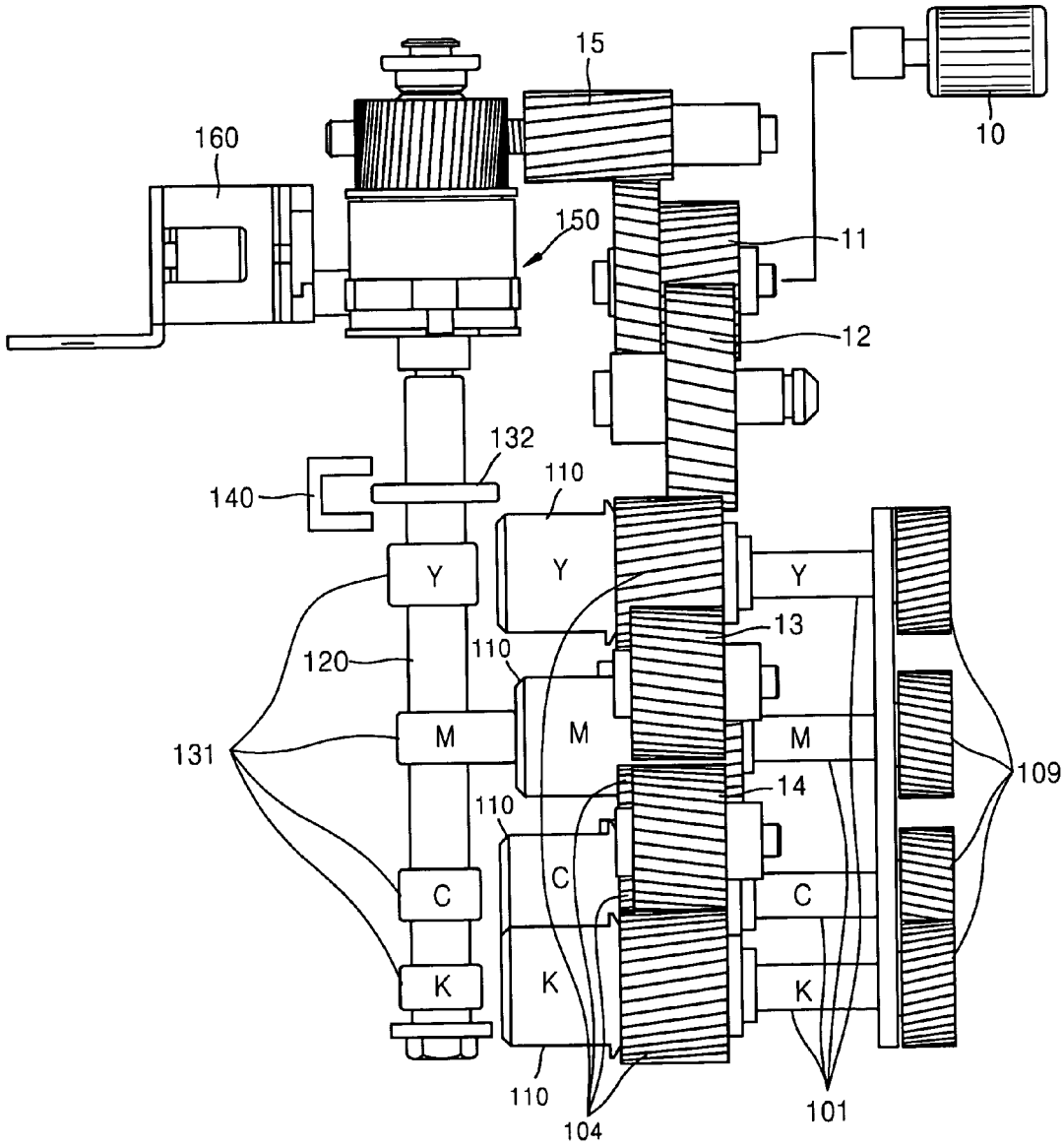
FIG. 2 is a plan view of an apparatus for selectively driving a plurality of developing units according to an exemplary embodiment of the present invention.

As shown in FIGS. 2 and 3, the cam shaft 120 is rotated by the driving motor 10. The cam shaft 120 rotates only when the rotational force of the driving motor 10 changes the rotation direction. Thus, the image forming apparatus includes a spring clutch 150 as a regulation means for regulating the rotational force of the driving motor 10 and an actuator 160 for selectively operating the spring clutch 150.

Figure 7:
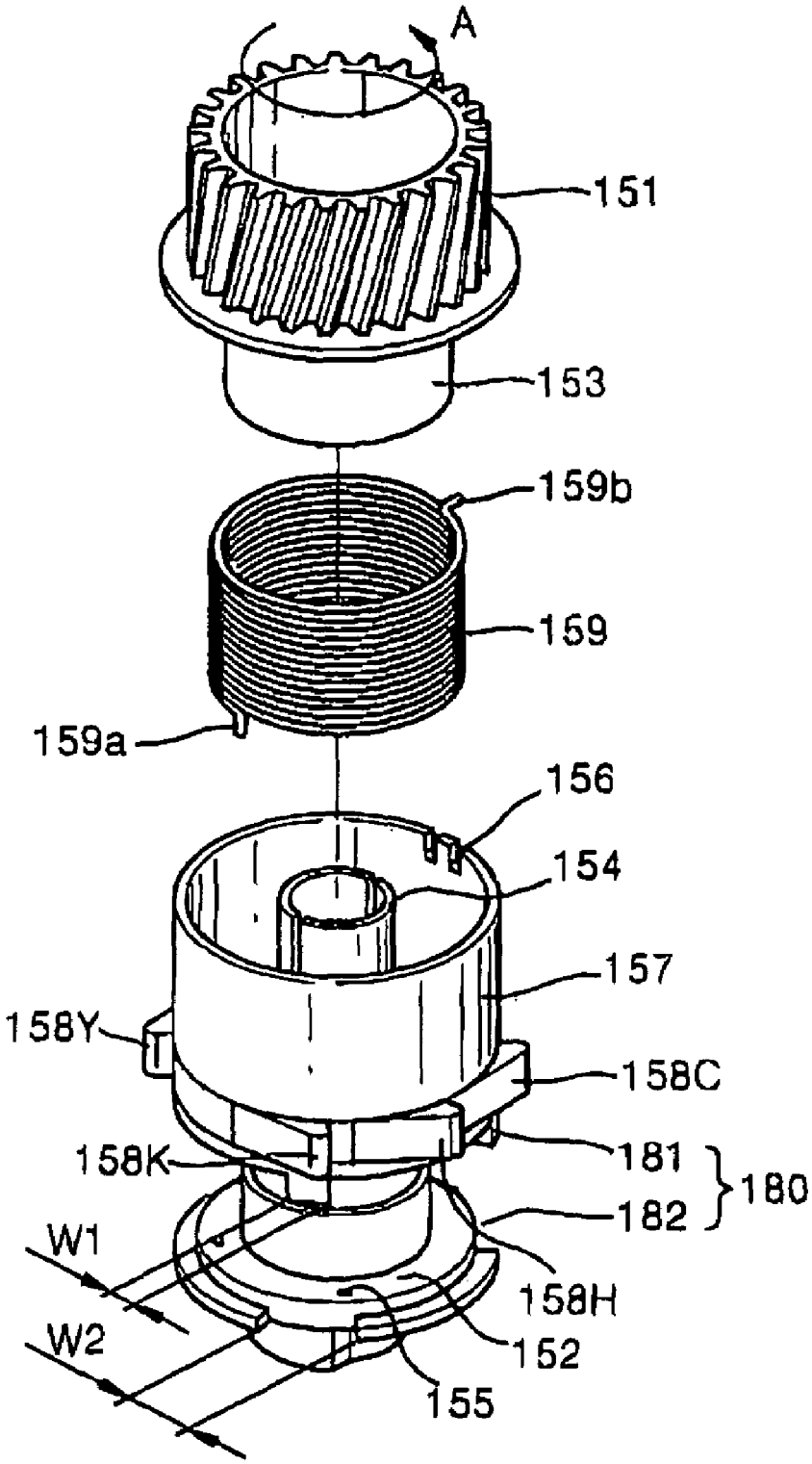
FIG. 7 is an exploded perspective view of a spring clutch according to an exemplary embodiment of the present invention.
Figure 8:
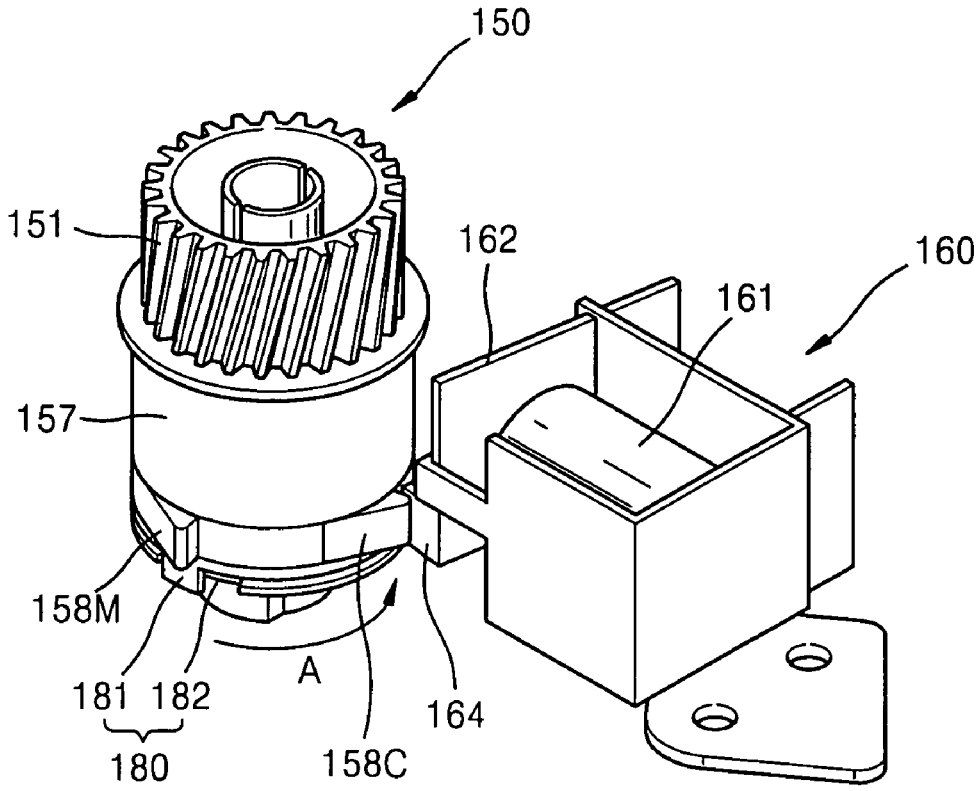
FIG. 8 is a perspective view illustrating operation of a spring clutch and a solenoid according to an exemplary embodiment of the present invention.
Figure 9:
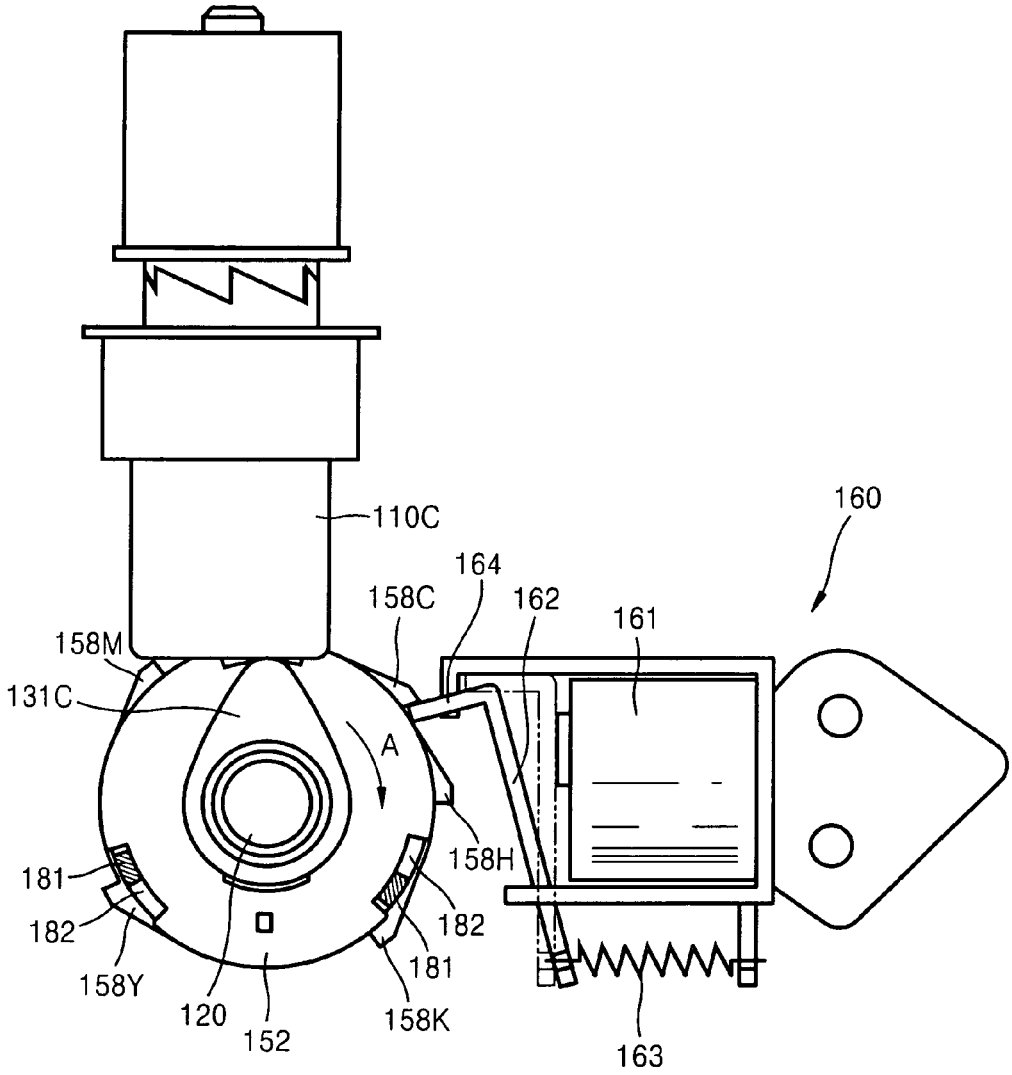
FIG. 9 is a rear plan view illustrating operation of a spring clutch and a solenoid according to an exemplary embodiment of the present invention.

Referring to FIGS. 7 to 9, the spring clutch 150 includes a clutch gear 151, a clutch spring 159, a clutch hub 157, and a clutch shaft 152.

The clutch shaft 152 is fixed to one end portion of the cam shaft 120, and the clutch gear 151 is rotatably connected with the clutch shaft 152. The clutch spring 159 is respectively inserted into the clutch gear 151 and cylinder portions 153 and 154 of the clutch shaft 152.

The clutch hub 157 covers the clutch spring 159. The clutch hub 157 includes four latch portions 158Y, 158M, 158C, and 158K of which phases correspond to the four cams 131 and a home position connection 158H. One end portion 159*a* and the other end portion 159*b* of the clutch spring 159 are respectively inserted into insert holes 155 and 156 provided at the clutch shaft 152 and the clutch hub 157. The clutch gear 151 is connected with a gear 15 that is rotated by the driving motor 10. The driving motor 10 rotates the clutch gear 151 in a direction indicated by arrow A.

The clutch spring 159 is twisted in a direction that narrows the inner diameter thereof and strongly tightens the clutch gear 151 and the cylinder portions 153 and 154 of the clutch shaft 152. As a result, when the clutch gear 151 rotates in the direction A, the clutch spring 159 and the clutch shaft 152 rotate along with the cam shaft 120. Because the other end portion 159*b* of the clutch spring 159 is inserted in the insert hole 156 of the clutch hub 157, the clutch hub 157 also rotates.

When current is not applied to a coil portion 161, a snag 164 of a movable plate 162 moves forwards as shown in a solid line in FIG. 9 and is snagged by the latch portions 158Y, 158M, 158C, and 158K and the home position connection 158H, thereby preventing the hub 157 from rotating.

Because the other end portion 159*b* of the clutch spring 159 is snagged by the insert hole 156 of the clutch hub 157, when the clutch hub 157 does not rotate, the clutch spring 159 is twisted in a direction that widens the inner diameter thereof. Then, the force that tightens the cylinder portion 153 of the clutch gear 151 by the clutch spring 159 becomes weak, the inner diameter portion of the clutch spring 159 and the cylinder portion 153 of the clutch gear 151 are slipped, and the clutch spring 159 and the clutch shaft 152 do not rotate. As a result, the cam shaft 120 stops rotating.

When current is applied to the coil portion 161, the movable plate 162 is attached to the coil portion 161 as shown by a broken line in FIG. 9, and the snag 164 is separated from the latch portions 158Y, 158M, 158C, and 158K and the home position connection 158*h*. Then, as mentioned above, the clutch gear 151 rotates along with the cam shaft 120.

A home position indication member 132 is provided at the cam shaft 120 to determine an initial position of the cam shaft 120. A sensor 140 detects the home position indication member 132. In an exemplary embodiment of the present embodiment, an optical sensor is used for the sensor 140. The home position connection 158H of which phase corresponds to the home position indication member 132 is provided at the clutch hub 157. When the snag 164 of the actuator 160 is connected with the home position connection 158H, the cam shaft 120 stops rotating when located at a home position.

In an exemplary embodiment of the present embodiment, the home position denotes a condition that the four developing units 4 have not yet been driven, or the four sliding hubs 104 and the respective fixed hubs 106 are separated from each other. The phase of the home position connection 158H is not overlapped with the phase of the batch portions 158Y, 158M, 158C and 158K. The phase of the home position indication member 132 precedes the phase of the home position connection 158H. When a current to be supplied to the actuator 160 is blocked after the home position indication member 132 is detected by the sensor 140, the movable plate 162 is located as shown in a solid line in FIG. 9. When the cam shaft 120 rotates and the home position connection 158H is snagged by the snag 164, a rotational force from the driving motor 10 is blocked and the cam shaft 120 stops at the home position.

Additionally, the image forming apparatus of an exemplary embodiment of the present invention includes a control means 180. The control means 180 serves to substantially prevent the cam shaft 120 from being excessively rotated by the clutch spring 159 in a condition where the movable plate 162 is connected with one of latch portions 158Y, 158M, 158C, and 158K.

When the cam shaft 120 excessively rotates in a condition where the movable plate 162 is connected with one of the latch portions 158Y, 158M, 158C, and 158K, the cams 131 also rotate, and the cams 131 are no longer able to completely push the push-cap 110. Thus, because the sliding hub 104 cannot be adhered to the fixed hub 106, the rotational force cannot be completely transferred to the developing units 4.

The control means 180 includes at least one control unit 181 provided at the clutch hub 157 and at least one control notch 182 respectively connected with the control unit 181.

The control unit 181 is disposed right under the latch portions 158Y, 158M, 158C, and 158K and protrudes toward the control notch 182 from the clutch hub 157. When the spring clutch 150 is assembled, the control unit 181 is respectively inserted into the control notch 182.

The width W2 of the control notch 182 is preferably greater than the width W1 of the control unit 181. By this, as shown in FIG. 9, when the spring clutch 150 rotates in the arrow direction A, the control unit 181 moves in the rotation direction and comes in contact with one side of the control notch 182 to substantially prevent the cam shaft 120 from excessively rotating, whereas when the spring clutch 150 rotates in the reverse direction with respect to the arrow direction A, a space margin for releasing the clutch spring 159 may be ensured.

The control means 180 is not limited to the forms of the control unit 181 and the control notch 182, but other suitable forms providing the same function may be used.

Operations of a control means having the aforementioned configuration according to the exemplary embodiments of the present invention are described with reference to the drawings hereafter.

Referring to FIGS. 1 to 4, the plurality of cams 131 must selectively come in contact with the plurality of push-caps 110 to transfer a driving force to the developing units 4.

For example, as shown in FIGS. 8 and 9, when the movable plate 162 of the actuator 160 is connected with the cyan latch portion 158C, the cam 131C of FIG. 6 pushes the push-cap 110C, while coming in contact with the push-cap 110C.

At this time, should the clutch spring 159 malfunction causing the clutch shaft 152 to excessively rotate, because the control unit 181 is connected with the control notch 182, the clutch shaft 152 may be substantially prevented from excessive rotation caused by the rotational force of the clutch spring 159. Thus, when the movable plate 162 is connected with one of the latch portions 158Y, 158M, 158C, and 158K, the cam shaft 120 may be substantially prevented from excessive rotation by the use of the control means 180.

Accordingly, in an image forming apparatus of an exemplary embodiment of the present invention, a push-cap is pushed in a condition where a cam is always stopped at a fixed position by the use of a control means, so a driving force may be accurately transferred to a developing unit, thereby improving reliability of the control means.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An image forming apparatus, comprising:

a plurality of developing units;

a cam shaft;

a plurality of cams provided on the cam shaft to correspond to the plurality of developing units and to sequentially operate the plurality of developing units as the cam shaft rotates;

a regulation means that controls a rotational force from a driving force source that is transferred to the cam shaft and that includes a spring clutch having a plurality of latch portions of which phases correspond to the plurality of cams and an actuator that is selectively connected to the plurality of latch portions and corresponds the plurality of cams to the plurality of developing units; and a control unit disposed at the spring clutch to substantially prevent the cam shaft from excessive rotation to prevent the cams from being separated from a corresponding position with respect to the selected developing unit, the spring clutch including a clutch gear that receives a driving force from the driving force source, a clutch shaft that is connected to the cam shaft, a clutch spring that is connected to the clutch gear and the clutch shaft and transfers the rotational force of the clutch gear to the clutch shaft, and a clutch hub that covers the clutch spring, one end of the clutch spring being fixed to the clutch hub, and the clutch hub having the plurality of latch portions.

2. The image forming apparatus according to claim 1, wherein the control unit comprises at least one control member provided at the clutch hub, and at least one control notch formed at the clutch shaft and is respectively connected with the control member.

3. The image forming apparatus according to claim 2, wherein the control member is protrudes toward the control notch.

4. The image forming apparatus according to claim 3, wherein the control member is inserted in and connected to the control notch.

5. The image forming apparatus according to claim 2, wherein the width of the control notch is greater than the width of the control member.

6. The image forming apparatus according to claim 5, wherein the control member is inserted in and connected to the control notch.

7. The image forming apparatus according to claim 2, wherein the control member is inserted in and connected to the control notch.

8. The image forming apparatus according to claim 2, wherein the plurality of latch portions are disposed between the at least one control member and the at least one control notch and the clutch gear.

9. The image forming apparatus according to claim 1, wherein the plurality of latch portions are disposed between the control unit and the clutch gear.

10. An image forming apparatus, comprising:

a plurality of developing units;

a cam shaft;

a plurality of cams provided on the cam shaft to correspond to the plurality of developing units and to sequentially operate the plurality of developing units as the cam shaft rotates;

a regulation means that controls a rotational force from a driving force source that is transferred to the cam shaft and that includes a spring clutch having a plurality of latch portions of which phases correspond to the plurality of cams and an actuator that is selectively connected to the plurality of latch portions and corresponds the plurality of cams to the plurality of developing units, the spring clutch including a clutch gear that receives a driving force from the driving force source;

a clutch shaft connected to the cam shaft;

a clutch spring connected to the clutch gear and the clutch shaft and transfers the rotational force of the clutch gear to the clutch shaft; and a clutch hub that covers the clutch spring, one end of the clutch spring being fixed to the clutch hub, and the plurality of latch portions being disposed on the clutch hub; and a control unit disposed at the spring clutch to substantially prevent the cam shaft from excessive rotation to prevent the cams from being separated from a corresponding position with respect to the selected developing unit, wherein the control unit comprises at least one control member disposed on the spring clutch, and at least one control notch correspondingly formed on the spring clutch to receive the at least one control member.

11. The image forming apparatus according to claim 10, wherein the at least one control member is connected to the clutch hub, and the at least one control notch is formed at the clutch shaft.

12. The image forming apparatus according to claim 11, wherein the control member protrudes toward the control notch.

13. The image forming apparatus according to claim 12, wherein the control member is inserted in and connected to the control notch.

14. The image forming apparatus according to claim 11, wherein the width of the control notch is greater than the width of the control member.

15. The image forming apparatus according to claim 14, wherein the control member is inserted in and connected to the control notch.

16. The image forming apparatus according to claim 10, wherein the control member is inserted in and connected to the control notch.

17. The image forming apparatus according to claim 10, wherein the plurality of latch portions are disposed between the control unit and the clutch gear.

* * * * *